United States Patent [19]

Reczek et al.

[11] Patent Number: 4,555,478

[45] Date of Patent: Nov. 26, 1985

[54] PHOTOGRAPHIC ELEMENT AND PROCESS FOR PROVIDING METAL COMPLEX COLOR IMAGES

[75] Inventors: James A. Reczek; Janice M. Palumbo, both of Rochester, N.Y.

[73] Assignee: Eastman Kodak Company, Rochester, N.Y.

[21] Appl. No.: 688,478

[22] Filed: Jan. 2, 1985

[51] Int. Cl.[4] ..... G03C 1/40; G03C 7/32

[52] U.S. Cl. ..... 430/367; 430/222; 430/226; 430/375; 430/378; 430/542; 430/543; 430/547

[58] Field of Search ..... 430/222, 226, 367, 375, 430/378, 542, 543, 547

[56] References Cited

U.S. PATENT DOCUMENTS 2,533,182 12/1950 Sargent ..... 430/375
4,142,891 3/1979 Baigrie et al. ..... 430/223

FOREIGN PATENT DOCUMENTS 59-44773 3/1984 Japan .
701843 1/1954 United Kingdom .

*Primary Examiner*—Richard L. Schilling
*Attorney, Agent, or Firm*—J. Lanny Tucker

[57] ABSTRACT

A process of obtaining highly stable color images comprises use of an element which has a support having thereon at least one silver halide emulsion layer having associated therewith an essentially colorless, immobile, ligand-releasing compound of the structure LIG-X. In this structure, LIG is a ligand which is capable of complexing with metal ions (e.g. ferrous ions) to form a metal complex dye, and X is a group which, as a function of silver halide development, is cleaved from LIG. A color image is formed by developing the described element after imagewise exposure with a developing agent to imagewise cleave the bond between the LIG and X, and treating the developed element with metal ions (e.g. ferrous ions) to form a metal complex dye image.

20 Claims, No Drawings

PHOTOGRAPHIC ELEMENT AND PROCESS FOR PROVIDING METAL COMPLEX COLOR IMAGES

RELATED APPLICATIONS

Reference is made to the following copending and commonly assigned applications, all filed on even date herewith: U.S. Ser. No. 688,479 by W. N. Washburn, U.S. Ser. No. 688,477 by F. V. Lovecchio, J. A. Reczek and R. C. Stewart and U.S. Ser. No. 688,224 by W. N. Washburn and K. R. Hollister.

FIELD OF THE INVENTION

This invention relates to color photography. In particular, it relates to photographic elements containing essentially colorless, immobile, ligand-releasing compounds, and to processes of using such elements to provide color images.

BACKGROUND OF THE INVENTION

It is well known in the photographic arts to record color images with photographic elements containing dye-providing materials which can be used to provide color images. Although the properties of dyes commonly used to provide such images (e.g. azo or azomethine dyes) have been optimized over the years, there is a continued search in the art for dyes which provide images having improved stability to heat, light, humidity and chemical reagents.

It is known that dye stability can be enhanced by forming metal-dye complexes. For example, U.S. Pat. No. 4,142,891 (issued Mar. 6, 1979 to Baigrie et al) relates to imaging in diffusion transfer assemblages with metal-complexed azo dyes.

Although metal-dye complexes are favorably regarded for their improved stability, most known metallized dyes or dye precursors are already colored at the time of imagewise exposure. If such dyes and silver halide are incorporated in the same layer of a photographic element, the dye will act as an unwanted filter, absorbing a portion of the incident radiation which otherwise would reach the silver halide. This results in a loss of sensitivity (i.e. photographic speed). Further, such colored dyes or dye precursors cannot be used in conventional white photographic papers.

One way to eliminate the unwanted filtering effect is to have the silver halide and the dye in separate layers while maintaining them in reactive association. While this is a useful and practical solution, it increases the number of layers in the element, making it thicker and presenting manufacturing and imaging inefficiencies.

It would, therefore, be desirable to form highly stable color images using dye precursors which are essentially colorless prior to imagewise exposure and development and can be placed in any layer in the element.

SUMMARY OF THE INVENTION

The present invention provides photographic elements which can be used to obtain color images of exceptional stability. Further, these elements and the process of using same provide desirable versatility in the placement of the dye-providing materials described herein because they are essentially colorless until development with development compositions after imagewise exposure and until treatment with metal ions. Hence, the problems of placement often encountered with known metallized of metallizable dyes can be avoided.

Therefore, in accordance with this invention, there is provided a photographic element which comprises a support having thereon at least one silver halide emulsion layer having associated therewith an essentially colorless, immobile, ligand-releasing compound of the structure LIG-X. In this structure, LIG is a ligand which is capable of complexing with metal ions to form a metal complex dye, and X is a group which, as a function of silver halide development, is cleaved from LIG.

This invention also provides a process of forming a dye image in the above-described element which has been imagewise exposed. This process comprises the steps of (a) developing the element to imagewise cleave the bond between LIG and X as a function of development; and (b) treating the element with metal ions to form a metal complex dye with LIG and the metal ions.

DETAILED DESCRIPTION OF THE INVENTION

The advantages described hereinabove for this invention are attained because of the use of the essentially colorless, immobile, ligand-releasing compound represented as LIG-X. The compounds LIG-X are "essentially colorless", meaning that prior to complexation of the LIG moiety with metal ions to form a visible dye, LIG-X exhibits essentially no observable color. That is, LIG-X exhibits a low optical density (i.e. less than about 0.05), although it may emit or reflect electromagnetic radiation in the non-visible portions of the electromagnetic spectrum. Therefore, the LIG moiety and the metal ions "form" a colored dye from a colorless precursor, as opposed to compounds which are merely shifted in their absorption $\lambda_{max}$ upon complexation with a metal ion to provide a dye of a different color.

LIG is a moiety, which when complexed with one or more metal ions, forms a visible dye. Depending on the way LIG and X are joined, this complexation can occur either while LIG and X are joined or after LIG is cleaved from X. In certain embodiments, LIG and X are joined such that LIG is incapable of complexing with metal ions until LIG and X are cleaved. In other words, the metal chelating site on LIG is blocked with X. In other embodiments, LIG and X are joined such that metal-LIG complexation can occur without LIG-X cleavage. Imagewise release and removal of LIG then allows metal complexation with the remaining LIG moiety still attached to X. In either case, complexation of metal ions with the LIG moiety provides a dye image as a function, either direct or inverse, of silver halide development.

Generally, the dyes formed upon complexation of the LIG moiety and metal ions are visibly colored dyes. That is, they absorb electromagnetic radiation in the visible portion of the electromagnetic spectrum, i.e. between about 400 and about 700 nm. More than one molecule of a LIG moiety can be complexed with one metal ion. For example, there may be two or three LIG molecules complexed with a single metal ion. Representative dyes which can be formed are cyan, yellow and magenta dyes.

Useful LIG moieties can be obtained from ferroin type compounds such as hydrazones, tetrazolylpyridines, pyridylquinazolines, bis-isoquinolines, imines, phenanthrolines, bipyridines, terpyridines, bidiazines, pyridyldiazines, pyridylbenzimidazoles, diazyltriazines, o-nitrosoanilines and phenols, tetrazines, triazines described by Schilt et al in the journal *Talanta,* 15, pp. 475–478 (1968), pyridine derivatives of phenazine and quinoxaline described by Schilt et al in *Talanta,* 15, pp. 852–855 (1968), substituted benzimidazole derivatives as described by Schilt et al, *Talanta,* 15, pp. 1055–1058 (1968), oximes of substituted methyl and phenyl 2-pyridyl ketones as described by Schilt et al, *Talanta,* 16, pp. 448–452 (1969), and the like. Other ligand-providing compounds are described in the following *Talanta* literature articles: 16, pp. 519–522 (1969), 13, pp. 895–902 (1966), 17, pp. 649–653 (1970), 19, pp. 1025–1031 (1972), 21, pp. 831–836 (1974), 22, pp. 915–917 (1975), 23, pp. 543–545 (1976), 24, pp. 685–687 (1977), 26, pp. 85–89 (1979), pp. 863–865 (1981), 36, pp. 373–376 (1979), 55, pp. 55–58 (1980), 29, pp. 129–132 (1982), and in Blandamer et al, *J. Chem. Soc. Dalton,* pp. 1001–1008 (1978), and Case, *J. Org. Chem.,* 31, pp. 2398–2400 (1966). The terpyridines are particularly useful for obtaining magenta dyes.

In certai embodiments, LIG can have a ballast group which renders LIG nondiffusible in the photographic element during processing. This type of ligand-releasing compound can be illustrated as BALL-LIG-X wherein LIG and X are as defined hereinabove, and BALL is an organic nonpolymeric or polymeric group of such molecular size and configuration as to render the compound nondiffusible in a photographic element during development in an alkaline processing composition. Particularly useful ballast groups include long chain alkhyl groups (e.g. 6 to 30 carbon atoms); as well as aromatic groups (phenyl, naphthyl) along with alkyl groups. Representative ballast groups include —CO—$C_{11}H_{23}$, —CO—$C_6H_4$(t—$C_{12}H_{25}$), —CON($C_{12}H_{25}$)$_2$, —$NHSO_2C_{16}H_{33}$, —$C_7H_{15}$,

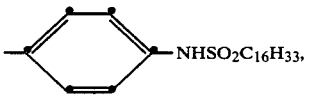

—$SO_2NHC_{18}H_{37}$, —$OC_{12}H_{25}$,

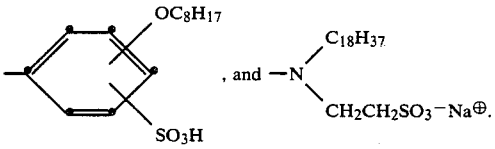

Examples of useful BALL-LIG-X compounds include:

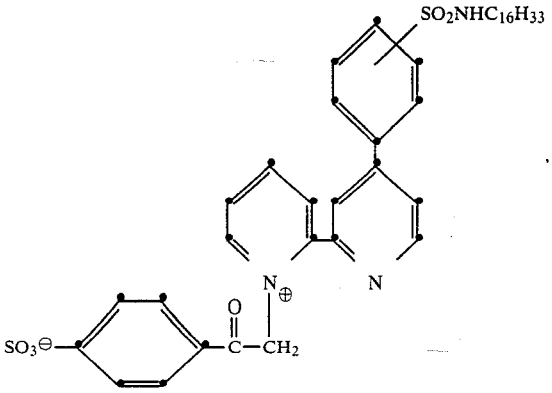

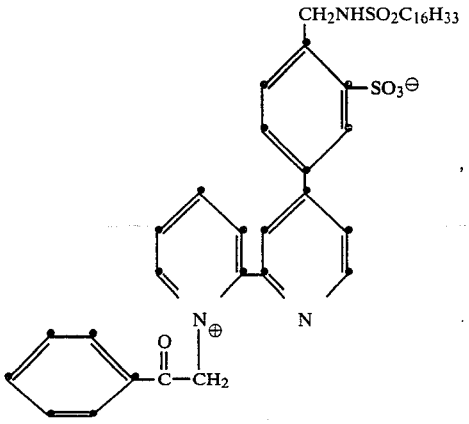

and a polymer having recurring units represented by the structure:

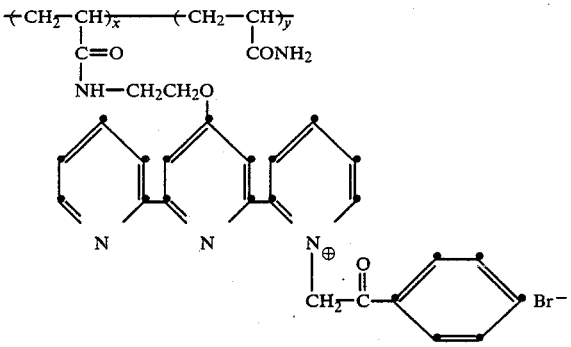

wherein x is from about 10 to 100 weight percent, and y is from about 0 to 90 weight percent.

Particularly useful LIG moieties are those derived from compounds represented by the structure:

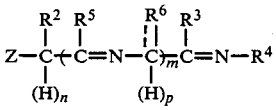

wherein m is 0 or a positive integer of 1 to 3, n and p are independently 0 or 1, and = represents a single or double bond.

Z is $R^1$—N=, O=, S=, $R^1$—P=, $(R^1)_2P$— or $(R^1)_3P$=, and when Z is $(R^1)_2P$—, n is 1, otherwise n is 0. Preferably, m is 0 or 1 and Z is $R^1$—N=.

$R^1$, $R^2$, $R^3$, $R^4$, $R^5$ and $R^6$ are independently hydrogen, amino (primary, secondary or tertiary), hydroxy, mercapto, alkoxy (preferably of 1 to 20 carbon atoms, e.g. methoxy, chloromethoxy, ethoxy, octyloxy, alkoxy substituted with imino, etc.), alkyl (preferably of 1 to 20 carbon atoms in the nucleus, e.g. methyl, ethyl, chloromethyl, isopropyl, t-butyl, heptyl, alkyl substituted with imino, etc.), aryl (preferably of 6 to 14 carbon atoms, e.g. phenyl, naphthyl, xylyl, p-methoxyphenyl, aryl substituted with imino, etc.), or a heterocyclic moiety (preferably having 5 to 20 carbon, nitrogen, sulfur or oxygen atoms in the nucleus, e.g. pyridyl, quinolyl, a heterocycle substituted with imino, etc.).

When $R^6$ is a group defined above, p is 1 and -- is a single bond.

Alternatively, if m is 0, $R^1$ and $R^2$, $R^2$ and $R^3$, and $R^3$ and $R^4$, taken together, can independently represent the carbon and heteroatoms (e.g. nitrogen, oxygen, sulfur, selenium, etc.) necessary to complete a substituted or unsubstituted 5 to 20 membered mono- or polycyclic carbocyclic or heterocyclic group (e.g. pyridine, quinolyl, triazinyl, phenanthrolinyl, pyrimidyl, etc.). The heterocyclic nucleus so formed can be substituted with one or more oxo, alkyl, amino, imino, aryl, phosphino (e.g. diphenylphosphino), alkoxy, amide, sulfonamide, thio or sulfo groups as defined above, or a heterocyclic group (e.g. pyridyl, pyrimidyl, thiazolyl, imidazolyl, thienyl, etc.).

If m is 1, 2 or 3, $R^1$ and $R^2$, $R^5$ and $R^6$, and $R^3$ and $R^4$, taken together, can independently represent the carbon and heteroatoms (e.g. nitrogen, oxygen, sulfur, selenium, etc.) necessary to complete a substituted or unsubstituted 5 to 20 membered mono- or polycyclic heterocyclic nucleus as defined above where m is 0. When $R^5$ and $R^6$ are so defined, p is 0 when -- is a double bond, and p is 1 when -- is a single bond.

If desired, LIG or a ballast group attached to it can contain one or more solubilizing groups, e.g. sulfate, sulfonate, carboxylate, hydroxy or phosphate groups.

Examples of useful LIG moieties which form color dye complexes with ferrous ions are shown below. In these structures, the point of attachment to X is represented by an unsatisfied bond. The approximate $\lambda_{max}$ of each resulting ferrous ion complex dye is also noted, however, the $\lambda_{max}$ can be shifted somewhat (e.g. 10–15 nm) depending upon the moiety to which LIG is attached.

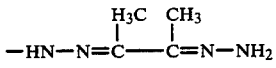

yellow, $\lambda_{max}$ = 422 nm

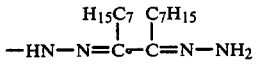

yellow, $\lambda_{max}$ = 443 nm

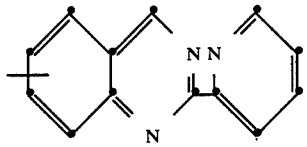

yellow, $\lambda_{max}$ = 441 nm

-continued

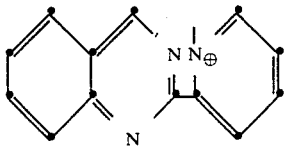

yellow, $\lambda_{max}$ = 441 nm

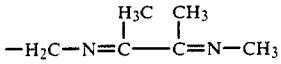

magenta, $\lambda_{max}$ = 564 nm

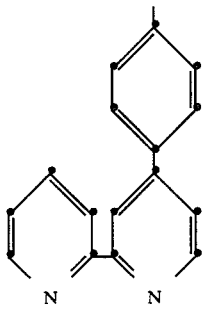

magenta, $\lambda_{max}$ = 536 nm

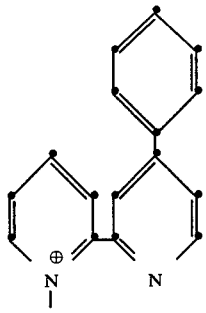

magenta, $\lambda_{max}$ = 536 nm

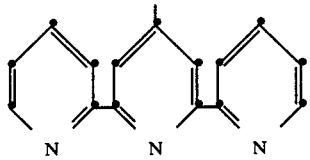

magenta, $\lambda_{max}$ = 555 nm

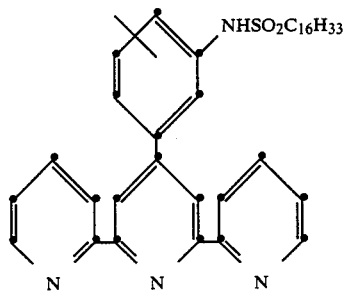

magenta, $\lambda_{max}$ = 571 nm

-continued

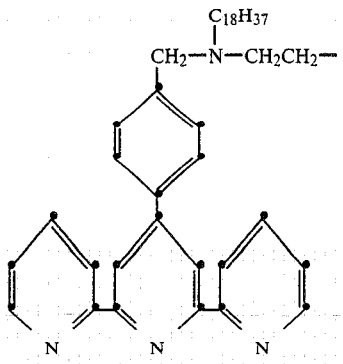

magenta, $\lambda_{max}$ = 567 nm

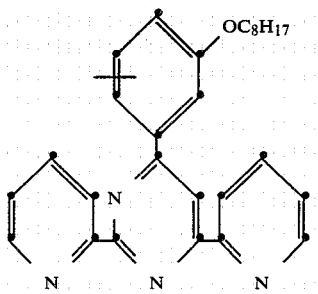

magenta, $\lambda_{max}$ = 583 nm

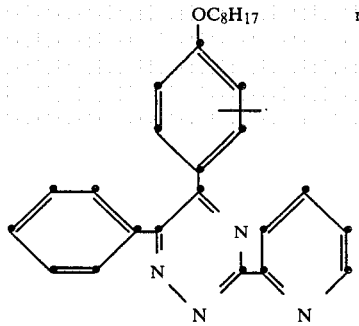

magenta, $\lambda_{max}$ = 557 nm

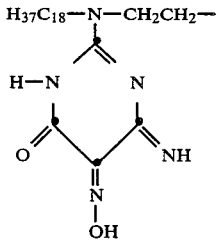

cyan, $\lambda_{max}$ = 644 nm

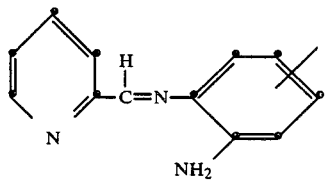

cyan, $\lambda_{max}$ = 670 nm and

-continued

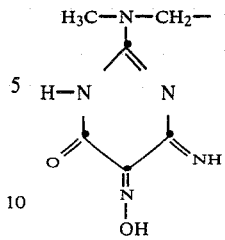

cyan, $\lambda_{max}$ = 650 nm.

X is any moiety which will react with oxidized developing agent (e.g. oxidized color developing agent). In preferred embodiments, it is a coupler moiety employed in conventional color-forming couplers which yields a colored product on reaction with oxidized color developing agents or which yields a colorless product on reaction with oxidized color developing agents. Both types of coupler moieties are well known to those skilled in the photographic art and described, for example, in *Research Disclosure,* publication 17643, paragraph VII, December, 1978, and references noted therein. *Research Disclosure* is available from Kenneth Mason Publications, Ltd., Emsworth, Hampshire P010 7DD, United Kingdom.

However, useful results can be obtained with this invention when X is another moiety known in the art to release dyes, or other photographically useful fragments as a result of silver halide development. Such moieties include redox dye releasers and similar compounds as described, for example, in U.S. Pat. Nos. 4,053,312 (issued Oct. 11, 1977 to Fleckenstein), 4,055,429 (issued Oct. 25, 1977 to Holmes et al), 4,076,529 (issued Feb. 28, 1978 to Fleckenstein, 4,139,379 (issued Feb. 13, 1979 to Chasman et al), 4,139,389 (issued Feb. 13, 1979 to Hinshaw et al), 4,199,354 and 4,199,355 (both issued Apr. 22, 1980 to Hinshaw et al), and 4,232,107 (issued Nov. 4, 1980 to Janssens) all of which are incorporated herein by reference in their entirety.

X can be unballasted or ballasted with an organic ballasting group as described above for LIG. X can be monomeric, or it can form part of a dimeric, oligomeric or polymeric coupler.

The LIG moiety is joined to X at any of the positions from which groups cleaved from couplers by reaction with oxidized developing agent can be attached. Preferably, LIG is attached to X in a coupling position so that upon reaction of the coupler with oxidized developing agent, LIG will be cleaved from X. However, LIG can be in a non-coupling position of X, from which position it will be cleaved as a result of reaction of X with oxidized developing agent. In the case where the LIG moiety is in a non-coupling position, other groups can be in the coupling position, including the conventional coupling off groups or the same or a different LIG moiety. Accordingly, the LIG-X compounds useful in this invention can provide more than one mole of LIG per mole of compound. The LIG moieties can be the same or different and can be cleaved at the same or different times or rates.

In a preferred embodiment of this invention, there is no linking group between X and LIG. The LIG moiety is blocked by X preventing complexation with metal ions, and cleavage by oxidized developer produces only the coupled product resulting from the coupling reaction with the oxidized developer and LIG. Examples of such preferred LIG-X compounds are:

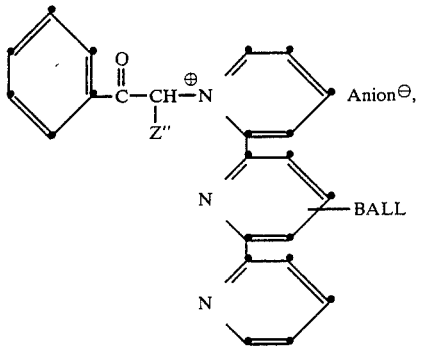

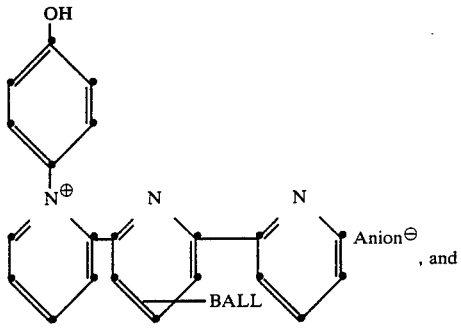

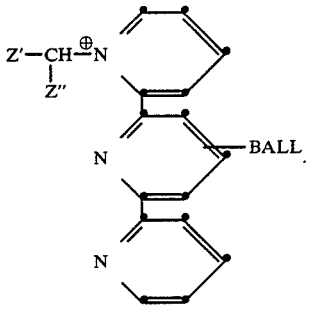

In these structures, Z' is an electron withdrawing group, Z'' is an electron withdrawing group, hydrogen, alkyl or aryl, BALL is a suitable ballasting group as defined above, and Anion− is a suitable anion.

Alternatively, release of LIG and X moieties linked with an organic blocking group (BL) can occur in several steps wherein the BL-LIG fragment is coupled off from the X moiety upon reaction with oxidized developer. The BL-LIG fragment is then capable of releasing the LIG moiety by an intramolecular reaction. The compounds are resistant to unblocking under storage conditions and in the absence of oxidized developer, but are unblocked upon release from the coupler during the coupling reaction.

The intramolecular reaction which results in release of the LIG moiety can be an elimination reaction such as occurs with

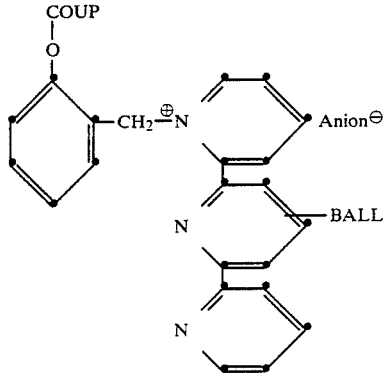

wherein COUP is any suitable coupler moiety. This concept is described in U.S. Pat. No. 4,409,323 (issued Oct. 11, 1983 to Sato et al).

Alternatively, the intramolecular release can occur by a nucleophilic displacement reaction, as occurs with

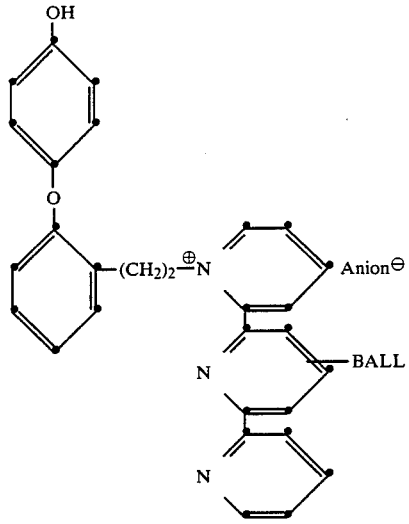

This concept is described in U.S. Pat. No. 4,248,962 (issued Feb. 3, 1981 to Lau). The term "intramolecular nucleophilic displacement reaction" is known in the art to refer to a reaction in which a nucleophilic center of a compound reacts directly, or indirectly through an intervening molecule, at another site on the compound which is an electrophilic center, to effect displacement of a group or atom attached to the electrophilic center. This type of reaction is described in more detail in U.S. Pat. No. 4,310,612 (issued Jan. 12, 1982 to Mooberry et al).

In yet another embodiment, LIG and X are connected with a single bond or with an organic linking moiety which generally remains with LIG when it is cleaved and is protonated or ionized depending upon the pKa of the group. Useful organic linking moieties include —COO—, —CONH—, —O—, —S—, —$SO_2$—, —$SO_2NH$—, —$CH_2CO$—, —$SO_2N$(Alkyl)— and the like as well as the timing groups described in U.S. Pat. No. 4,248,962 (issued Feb. 3, 1981 to Lau), the disclosure of which is incorporated herein by reference.

A particularly useful linking group is a single bond or —O—.

Examples useful in the practice of this embodiment of the invention as X moieties are the following color coupler moieties:

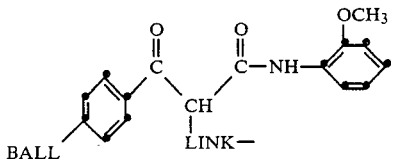

I.

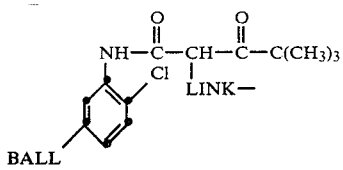

II.

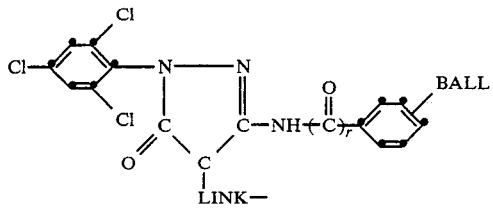

III.

wherein r is 0 or 1,

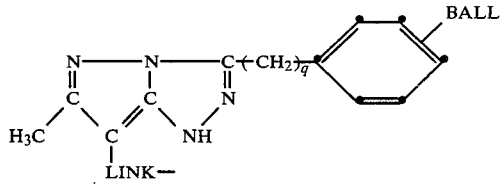

IV.

wherein q is an integer of 1 to 20,

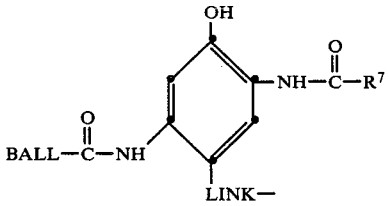

V.

wherein $R^7$ is substituted or unsubstituted alkyl (preferably of 1 to 20 carbon atoms) or substituted or unsubstituted aryl (preferably of 6 to 14 carbon atoms),

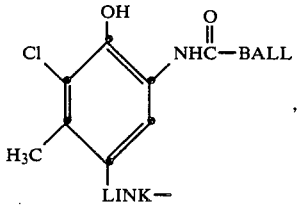

VI.

, and

-continued

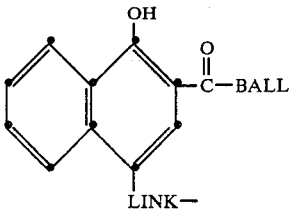

VII.

In these formulae, BALL is any suitable ballast group as described above (e.g. —$NHSO_2C_{16}H_{33}$, —NHCO-alkylene-oxy-aryl, alkyl of 1 to 20 carbon atoms, aryl of 6 to 14 carbon atoms in the nucleus, etc.), and LINK is a suitable linking moiety, as described above, which links X and LIG prior to reaction with oxidized developing agent. BALL can also be a suitable polymer backbone.

Representative LIG-X compounds useful in the practice of this invention include the following:

N-{{4-chloro-3-{4,4-dimethyl-3-oxo-2-[4'-(2,2':6',2''-terpyridyl)oxy]pentanamido}phenyl}}hexadecanesulfonamide, a magenta dye-providing compound, 1-hydroxy-N-[4-(2,4-di-t-pentylphenoxy)butyl]-4-[4'-(2,2':6',2''-terpyridyl)oxy]-2-naphthamide, a magenta dye-providing compound, 4-{{4,4-dimethyl-3-oxo-2-{3-[4'-(2,2':6',2''-terpyridyl)]-phenoxy}pentanamido}}-N-methyl-N-octadecylbenzenesulfonamide, a magenta dye-providing compound, 1-hydroxy-4-{{{4-nitro-2-{{N-isopropyl-N-{4-[6-phenyl-3-(2-pyridyl)-1,2,4-triazin-5-yl]phenoxycarbonyl-}aminomethyl}}phenoxy}}}-N-(2-tetradecyloxyphenyl)-2-naphthamide, a magenta dye-providing compound, and 1-hydroxy-N-[4-(2,4-di-t-pentylphenoxy)butyl]-4-{{{4-{{N-{2-[4'-(2,2':6',2''-terpyridyl)oxy]ethyl}sulfamoyl}}phenoxy}}}-2-naphthamide, a magenta dye-providing compound.

The LIG-X compounds useful in the practice of this invention can be readily prepared using chemical reactions known to one skilled in photographic chemistry. Generally, a compound from which the LIG moiety is derived is reacted with a compound (e.g. a color coupler) from which X can be derived. Detailed syntheses of exemplary LIG-X compounds are provided below.

In certain embodiments, the following general preparatory techniques can be used:

(a) Reaction of a LIG moiety containing a hydroxy group with a color coupler containing a leaving group (e.g. halogen, tosylate, mesylate, sulfonium salt, etc.) in the coupling off position to produce a LIG-X compound of the invention having the LIG moiety bonded to the X coupler moiety through an —O— linkage. Alternatively, a LIG moiety having a mercapto group could be used to obtain a LIG-X compound having the LIG and X moieties liked through an —S— linkage.

(b) Reaction of a color coupler having a hydroxy group with a LIG moiety containing a leaving group (as defined above) to produce the same kind of LIG-X compound as described in (a).

In other embodiments, LIG-X compounds useful in this invention can be prepared by condensation of a LIG-containing carboxylic acid halide or sulfonic acid halide with a color coupler containing a hydroxy, mercapto or amino group in the coupling position to produce LIG-X compounds having LIG and X moieties joined by an ester, amide, sulfonamide or thioester linkage.

The LIG-X compounds preferred for use in this invention can be prepared, in general, by the reaction of a ballasted and optionally solubilized LIG moiety with a coupler moiety containing a leaving group in the coupling-off position. This results in quaternization of LIG by the coupler to form LIG-X where the chelation site of LIG is blocked. Alternatively, the LIG moiety can contain an ethylenically unsaturated polymerizable monomer group (such as acrylamide, acrylate, etc.). The LIG-X compound resulting from reaction with a coupler moiety can be polymerized to yield a polymeric LIG-X compound.

As noted hereinabove, LIG is a moiety capable of complexing with metal ions to provide desired dyes in one or more layers of photographic elements. A variety of metal ions can be so used as long as the complex of the LIG moiety with the metal ion is stable, or in other words, the complex is likely to remain in complexed form for a substantial period of time. In general, the log of the formation constant of such complexes should be in the range of from about 10 to about 30, and preferably from about 15 to about 25. Useful metal ions include $Fe^{++}$, $Co^{++}$, $Cu^{+}$, $Cu^{++}$, $Ru^{++}$ and $Os^{++}$. Ferrous ions are preferred in the practice of this invention.

In the practice of this invention, cleavage of LIG from X results from reaction of oxidized developing agent with the LIG-X compound. Any suitable developing agent can be used in the practice of this invention, which when oxidized from silver halide development, can react with LIG-X. Particularly useful developing agents are color developing agents, including aminophenols, phenylenediamines, tetrahydroquinolines and the like as described, for example, in *Research Disclosure,* publication 17643, paragraph XX, noted above. Other useful developing agents include hydroquinones, catechols and pyrazolidones.

In a preferred embodiment of this invention, a negative image can be generated in an element. This is done by incorporating in the element a LIG-X compound wherein X is a moiety which yields a colorless or diffusible reaction product with oxidized developer, and X is attached to LIG in such a manner that it is incapable of complexation with metal ions prior to the reaction with oxidized developer. LIG is appropriately ballasted as outlined above to prevent diffusion. Upon imagewise development with a developing agent, the LIG-X bond is cleaved in exposed areas, and the coupled product may be washed out of the element if desired. Subsequent treatment of the element with metal ions (e.g. ferrous ions) either during the bleach step or in a separate metallization step provides dyes in the exposed areas, resulting in a negative image.

In another embodiment of this invention which is the subject of the above-noted patent application of our colleague, W. N. Washburn, U.S. Ser. No. 688,479, LIG and X are joined such that LIG is capable of complexing with metal ions without cleavage of the LIG-X bond. In other words, the metal chelating site in LIG is not blocked by X. As illustrated in more detail in the Washburn application, in the exposed areas of the element, a conventional color dye image is formed with a conventional color coupler and the LIG-X bond is cleaved as a function of silver halide development to yield a soluble ligand which diffuses out of the element during processing so that it is unavailable to form a metal complex dye. The reaction product of X and the oxidized developing agent can be colorless or diffusable, in which case it will not contribute to image density, or colored in which case it can augment or modify the principal dye image. In the unexposed areas, the unreacted LIG-X compound is treated with metal ions (e.g. ferrous ions) to provide a visually colored dye which acts as a masking dye in those areas.

The present invention can also be used to generate a reversal image in an element using what are known in the art as "universal" couplers. This can be done by incorporating a LIG-X compound in the element wherein X is a moiety which yields a colorless or diffusible reaction product with oxidized developing agent and LIG is a moiety capable of complexing with metal ions to provide a dye while still linked to X. Upon imagewise development with a developing agent, the LIG-X bond in exposed areas is cleaved and fragments washed out of the element. Subsequent treatment of the element with metal ions (e.g. ferrous) provides dyes in unexposed areas to provide a reversal image.

In still another embodiment, the photographic element of this invention can provide a diffusion transfer image. This element comprises a support and a plurality of layers including one or more image-recording layers and an image-receiving layer. A LIG-X compound is incorporated in or adjacent an image-recording layer, and the LIG-X bond is cleaved as a function of development either via coupling off chemistry or redox release chemistry. Redox release chemistry is described, e.g. in U.S. Pat. Nos. 4,108,850 (issued Aug. 22, 1978 to Fields et al) and 4,139,379 (issued Feb. 13, 1979 to Chasman et al), whereupon reduction of a hydroquinone compound releases a dye fragment. In either case, the released LIG moiety diffuses to the image-receiving layer which contains mordanted metal ions. These ions complex with the LIG moiety to provide the desired dye image.

The photographic elements and film units of this invention can be processed by conventional techniques in which the processing solutions or compositions are incorporated in the element or film unit or are separately applied in a solution or process sheet. These solutions or compositions contain developing agents (e.g. color developing agents) and other conventional processing addenda, as well as metal ions to complex with LIG, if desired. Alternatively, the metal ions can be incorporated within the element in the same or different layer as the LIG-X compound. More specifically, processing of the elements of this invention can be accomplished by conventional silver development, either color or black and white, for example, by treatment with a phenylenediamine or hydroquinone developer, followed by bleaching with an $Fe^{+3}$ salt bleach, or simply by treatment of the imagewise distribution of LIG with ferrous ions. Electron transfer agents can be used in redox release processes. The ferrous or other ions can be included in the bleach solution for complexation with the LIG moiety.

Photographic elements of this invention in which the described LIG-X compounds are incorporated can comprise a support and one or more silver halide emulsion layers and associated dye-forming layers. The LIG-X compounds can be incorporated in the silver halide emulsion layer or in another layer, such as an adjacent layer, where they will come into reactive association with oxidized color developing agent which has developed silver halide in the emulsion layer. The silver halide emulsion layer can contain, or have associated with it, photographic coupler compounds, such as color forming couplers, colored masking couplers, etc. These coupler compounds can form dyes of the same or different color or hue as the dyes formed by complexation of LIG and metal ions. Additionally, the silver halide emulsion layer can contain other addenda conventionally contained in such layers.

A multilayer, multicolor photographic element of this invention can comprise a support having thereon a red-sensitive silver halide emulsion unit having associated therewith a cyan dye image providing material, a green-sensitive silver halide emulsion unit having associated therewith a magenta dye image providing material and a blue-sensitive silver halide emulsion unit having associated therewith a yellow dye image-providing material, at least one of the silver halide emulsion units having associated therewith a LIG-X compound. Each silver halide emulsion unit can be composed of one or more layers and the various units and layers can be arranged in different locations with respect to one another as is known in the art. The LIG-X compounds described herein can be incorporated into or associated with one or more units or layers of the element. Preferably, the LIG-X compound is in or associated with the green-sensitive silver halide emulsion unit.

The light sensitive silver halide emulsions can include coarse, regular or fine grain silver halide crystals or mixtures thereof and can be comprised of such silver halides as silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized. The emulsions generally are gelatin-containing emulsions although other natural or synthetic hydrophilic colloids, soluble polymers or mixtures thereof can be used if desired.

The element support can be any suitable substrate used in photographic elements. Examples of such supports include films of cellulose nitrate, cellulose acetates, poly(vinyl acetal), polyesters [e.g. poly(ethylene terephthalate)], polycarbonates and other resinous materials, glass, metals, paper, and the like. Generally, a flexible paper or resinous film support is used, and a paper support is particularly useful. Paper supports can be acetylated or coated with baryta and/or an $\alpha$-olefin polymer such as polyethylene, polypropylene, ethylene-butene copolymer and the like.

Further details regarding silver halide emulsions and photographic elements, including diffusion transfer elements, are well known in the art as described, for example, in *Research Disclosure,* publication 17643, noted above, as well as in *Research Disclosure,* publication 15162, November, 1976 and U.S. Pat. No. 4,358,525 (issued Nov. 9, 1982 to Mooberry et al).

PREPARATION 1

A useful magenta dye-forming LIG-X compound is 1-hydroxy-N-[4-(2,4-di-t-pentylphenoxy)butyl]-4-[4'-(2,2':6',2''-terpyridyl)oxy]-2-naphthamide which was prepared in the following manner.

To a solution of 12.25 g (25 mmole) of 1,4-dihydroxy-N-[4-(2,4-di-t-pentylphenoxy)butyl]-2-naphthamide and 3.1 g (10 mmole) of 2,6-di-2-pyridyl-4-methylsulfonopyridine in 100 ml of dry N,N-dimethylformamide (DMF) under $N_2$ was added in portions 2.4 g (50 mmole) of 50% NaH. After hydrogen evolution was complete, the solution was heated to 90° C. for two hours. Thin layer chromatography analysis (9/1 $CH_3CN$/MeOH) revealed that all of the sulfone was consumed. The reaction mixture was poured into 2 l of dilute $KH_2PO_4$ buffer, and the product solidified upon stirring. After removal of the solvent, the crude product was triturated several times with cyclohexane to remove unreacted naphthamide. The resulting purified LIG-X compound was isolated by filtration as a tan solid (9 g). Analysis by mass spectroscopy showed the compound to be consistent with the assigned structure.

PREPARATION 2

The monomer 1-benzoylmethyl-2-[4-(2-acrylamidoethoxy)-6-(2,2'-bipyridyl)]pyridinium bromide was prepared in the following manner.

A mixture of 10.00 g (20 mmole) of N-{2-[2,6-di(2-pyridyl)-4-pyridyloxy]ethyl}acrylamide and 5.79 g (29 mmole) of $\alpha$-bromoacetophenone in 10.0 ml DMF was stirred at 80° C. under argon for 3.5 hours. Upon cooling to room temperature, the resulting solid mass was triturated with $CH_2Cl_2$ to remove unreacted starting materials. The crude product was filtered, washed with $CH_2Cl_2$ and taken up in methanol. The methanol solution was evaporated in vacuo to a clear oil. Addition of $CH_2Cl_2$ followed by trituration yielded 6 g of a white solid. Elemental and nuclear magnetic resonance (NMR) analyses showed the resulting compound to be consistent with the assigned structure.

PREPARATION 3

A useful magenta dye-forming polymeric LIG-X compound is poly{acrylamide-co-1-benzoylmethyl-2-[4-(2-acrylamidoethoxy)-6-(2,2'-bipyridyl)]pyridinium bromide} which is prepared in the following manner.

To a solution of acrylamide (24.0 g, 0.34 mole) and 1-benzoylmethyl-2-[4-(2-acrylamidoethoxy)-6-(2,2'-bipyridyl)]pyridinium bromide (6.0 g, 0.011 mole) in water (300 ml) and ethanol (50 ml) was added 2,2'-azobis(2-methylpropionitrile) (0.60 g) as an initiator. The mixture was maintained under a nitrogen atmosphere and heated to 65° C. After 1.5 hour, degassed water (nitrogen gas bubbled into the water for 15 minutes) (200 ml) was added and heating at 65° C. was continued for 4.5 hours. The resulting polymer solution was then purified by dialysis in distilled water to give, after concentration, 10.3% solids (27 g, 89% yield).

PREPARATION 4

A useful magenta dye-forming LIG-X compound is N-{{4-chloro-3-{4,4-dimethyl-3-oxo-2-[4'-(2,2':6',2''-terpyridyl)oxy]pentanamido}-phenyl}}hexadecanesulfonamide which was prepared in the following manner:

The following were added to a 25 mL flask equipped with a stirrer: 0.5 g (2 mmole) of 2,6-di-2-pyridyl-4-hydroxypyridine, 0.43 g (3.75 mmole) of tetramethylguanidine, 5 ml of $CH_3CN$ and 1.5 g (2.7 mmole) of N-[4-chloro-3-(2-chloro-3-oxo-4,4-dimethylpentanamido)phenyl]hexadecanesulfonamide. The resulting mixture was heated at 40° C. with stirring for one hour. A thin layer chromatography analysis (10% EtOAc/$CH_3CN$) revealed that starting terpyridine remained, so another 0.3 g of the hexadecanesulfonamide and 0.1 g of tetramethylguanidine were added to the mixture. The reaction mixture was stirred an additional five hours whereupon the solvent was removed. The residue was chromatographed on silica gel. Nonpolar degradation products of the coupler were eluted with 10% cyclohexane/$CH_2Cl_2$ up to $CH_2Cl_2$. The desired LIG-X compound was eluted with 10% EtOAc/$CH_2Cl_2$ up to 50% $CH_2Cl_2$/EtOAc. Removal of the solvent left 0.8 g of a glassy solid identified as the desired magenta dye by mass spectroscopy.

PREPARATION 5

A useful magenta dye-forming LIG-X compound is 4-}}4,4-dimethyl-3-oxo-{3-[4'-(2,2':6',2''-terpyridyl]-phenoxy}pentanamido}}-N-methyl-N-octadecylbenzenesulfonamide which was prepared in the following manner.

To a solution of 1.4 ml of triethylamine (2 equivalents) in 100 ml of dry acetonitrile were added 3 g of

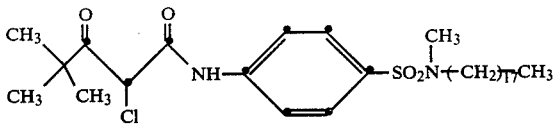

and 1.63 g of

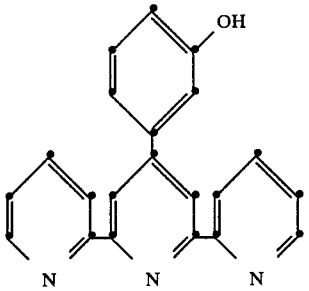

The resulting reaction mixture was refluxed under argon for 24 hours. Upon cooling, 2.5 g of a white solid was collected by filtration. The material showed one spot on thin layer chromatography and possessed infrared, NMR and mass spectra consistent with the assigned structure.

PREPARATION 6

Another useful magenta dye-forming LIG-X compound is 1-hydroxy-4-{{{4-nitro-2-{{N-isopropyl-N-{4-[6-phenyl-3-(2-pyridyl)-1,2,4-triazin-5-yl]phenoxycarbonyl}aminomethyl}}phenoxy}}}-N-(2-tetradecyloxyphenyl)-2-naphthamide which was prepared in the following manner.

The reactants

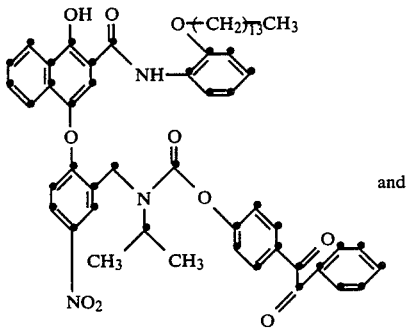

and

-continued

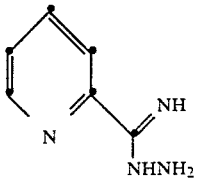

were combined (2.5 g and 0.37 g, respectively) in 100 ml of ethanol and refluxed under argon overnight. Upon cooling to room temperature, the product oiled out. Slow evaporation of the solvent and grinding with a stirring rod caused the product to solidify. Recrystallization from isopropanol afforded 1.70 g of buff yellow solid showing a one spot thin layer chromatography with a very slight trace of the first reactant and infrared, NMR and mass spectra consistent with the assigned structure.

PREPARATION 7

Another useful magenta dye-forming LIG-X compound is 1-hydroxy-N-[4-(2,4-di-t-pentylphenoxy)-butyl]-4-{{{4-{{N-{2-[4'-(2,2':6',2''-terpyridyl)oxy]ethyl}sulfamoyl}}phenoxy}}}-2-naphthamide which was prepared in the following manner.

To a solution of 0.584 g of

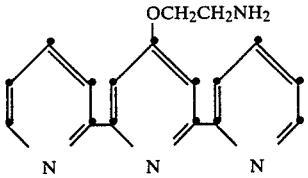

and 0.4 g of dry triethylamine in 100 ml of tetrahydrofuran, was added a solution of 1.33 g of

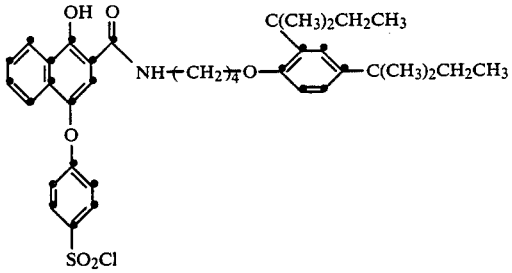

in 20 ml of tetrahydrofuran. After total addition, the reaction mixture was stirred at room temperature for two hours. The resulting $Et_3N.HCl$ was filtered off, 0.5 ml of glacial acetic acid was added and the filtrate was reduced to dryness. The residue was taken up in $CH_2Cl_2$, washed with 1 normal acetic acid, water, and brine and then dried over $Na_2SO_4$. The $CH_2Cl_2$ was removed in vacuo and the resulting material redissolved in ethyl ether and evaporated to dryness to afford 1.69 g of a fluffy white solid having infrared, NMR and mass spectra consistent with the assigned structure.

The following examples are provided to illustrate the practice of this invention.

EXAMPLE 1

Photographic Element Containing Polymeric LIG-X Compound which Provides a Magenta Dye Complex with Ferrous Ions To a warm stirred solution of poly{acrylamide-co-1-benzoylmethyl-2-[4-(2-acrylamidoethoxy)-6-(2,2'-bipyridyl)pyridinium]bromide} (10.3% solids, 58.04 g solution), was added 12.5% gel solution (30.6 g), 10% Alkanol XC TM surfactant solution (3.8 g), a spreading agent solution (4.3 g), and distilled water (41.0 g). A coating composition was prepared by adding 6.3 ml of silver halide emulsion containing 160 mg Ag/ml and 60 mg gelatin/ml to the above solution. The emulsion was then coated on a cellulose acetate support at about 129 ml/$m^2$ laydown. An overcoat solution containing 1.07 g gelatin/$m^2$ and 85 mg of 2% bis(vinylsulfonylmethyl) ether hardener solution/$m^2$ was coated over the emulsion at about 54 ml/$m^2$ laydown.

The resulting photographic element was imagewise exposed, developed with pH 11 phenylenediamine color developing solution to cleave LIG from X (polymeric backbone), bleached with ferric ethylenediaminetetraacetic acid (EDTA) bleach solution, and fixed. The element was then placed into a dilute ferrous ammonium sulfate solution (0.1 molar) which provided ferrous ions which complexed with the free LIG moiety to form a magenta dye image in imagewise exposed areas.

EXAMPLE 2

Photographic Element Containing LIG-X Compound as Masking Dye

This example is taken from the Washburn patent application, U.S. Ser. No. 688,479, noted above. It illustrates the use of LIG-X compounds to provide masking dyes in a photographic element.

A 1:1 molar ratio of a conventional cyan dye-providing coupler, N-[N'-(4-cyanophenyl)ureido-3-hydroxyphenyl]-2-(2,4-di-t-pentylphenoxy)hexanoic acid amide and a colorless magenta dye-providing LIG-X compound, 1-hydroxy-N-[4-(2,4-di-t-pentylphenoxy)butyl]-4-[4'-(2,2':6',2''-terpyridyl)oxy]-2-naphthamide dissolved in half their weight of dibutyl phthalate and three times their weight of ethyl acetate was dispersed in a silver bromoiodide emulsion on a cellulose acetate support. The coating levels were 0.48 g/$m^2$ of magenta dye-providing LIG-X compound, 0.58 g/$m^2$ of a conventional cyan dye-providing color coupler, 0.9 g/$m^2$ of Ag and 3.8 g/$m^2$ of gelatin.

The resulting element was imagewise exposed, developed with a phenylenediamine color developing solution (pH 10) and bleached using a ferricyanide-based bleach solution. This process provided a cyan dye image in the exposed areas and cleaved the terpyridyl LIG moiety from the X moiety in those areas. The free LIG moiety was washed out of the element in the processing solutions. The element was then placed into a dilute ammonium ferrous sulfate solution ($10^{-3}$ molar), providing ferrous ions which complexed with the LIG moiety of the uncoupled LIG-X compound, generating a magenta color correcting dye image in the unexposed areas of the element.

The invention has been described in detail with particular reference to preferred embodiments thereof, but it will be understood that variations and modifications can be effected within the spirit and scope of the invention.

We claim:

1. A photographic element comprising a support having thereon at least one silver halide emulsion layer having associated therewith an essentially colorless, immobile, ligand-releasing compound of the structure LIG-X wherein LIG is a ligand which is capable of complexing with metal ions to form a metal complex dye, and X is a group which, as a function of silver halide development, is cleaved from LIG.

2. The element of claim 1 wherein X is a coupler moiety and LIG is joined to the coupling position thereof so that, upon reaction of said coupler moiety with oxidized developing agent, LIG is cleaved from X.

3. The element of claim 1 wherein LIG and X are joined such that LIG is incapable of complexing with said metal ions until LIG is cleaved from X.

4. The element of claim 3 wherein X is a coupler moiety which forms a colorless reaction product upon reaction with oxidized developing agent.

5. The element of claim 3 wherein X is a coupler moiety which forms a diffusible reaction product upon reaction with oxidized developing agent.

6. The element of claim 1 wherein LIG and X are joined such that LIG is capable of complexing with said metal ions while LIG is joined to X, and upon cleavage from X, LIG is capable of diffusing out of said element.

7. The element of claim 6 wherein X is a coupler moiety which forms a colorless reaction product upon reaction with oxidized developing agent.

8. The element of claim 6 wherein X is a coupler moiety which forms a diffusible reaction product upon reaction with oxidized developing agent.

9. The element of claim 1 wherein said metal ions are ferrous ions.

10. The element of claim 9 wherein LIG forms a magenta dye upon complexing with ferrous ions.

11. A photographic element comprising a support having thereon at least one silver halide emulsion layer having associated therewith an essentially colorless, immobile, ligand-releasing compound of the structure LIG-X wherein LIG is a ligand which is capable of complexing with metal ions to form a metal complex dye, and X is a group which, as a function of silver halide development, is cleaved from LIG, said LIG being derived from a compound represented by the structure:

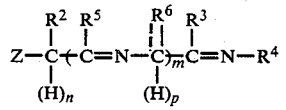

wherein m is 0 or a positive integer of 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

12. The element of claim 11 wherein m is 0 or 1 and Z is $R^1$—N═.

13. The element of claim 11 wherein said metal ions are ferrous ions.

14. A photographic element comprising a support having thereon, in order, a red-sensitive emulsion unit which has associated therewith a color coupler compound which is capable of forming a cyan dye, a green-sensitive silver halide emulsion unit which has associated therewith an essentially colorless, immobile ligand-releasing compound of the structure LIG-X wherein LIG is a ligand which is capable of complexing with metal ions to form a metal complex dye, and X is a group which, as a function of silver halide development, is cleaved from LIG, and a blue-sensitive silver halide emulsion unit which has associated therewith a color coupler compound which is capable of forming a yellow dye, said LIG being derived from a compound represented by the structure:

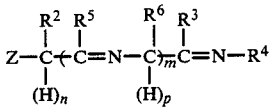

wherein m is 0 or a positive integer of 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1, otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, and when $R^6$ is so defined, p is 1 and ═ is a single bond if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

15. The element of claim 14 which is a photographic paper product.

16. A process of forming a dye image in an imagewise exposed element of claim 1, said process comprising the steps of (a) developing said element to imagewise cleave the bond between LIG and X as a function of development; and (b) treating said element with metal ions to form a metal complex dye with LIG and said metal ions.

17. The process of claim 16 wherein said metal ions are ferrous ions.

18. The process of claim 16 wherein LIG is derived from a compound represented by the structure:

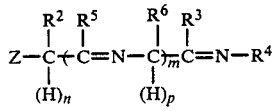

wherein m is 0 or a positive integer of 1 to 3, n and p are independently 0 or 1, ═ represents a single or double bond, Z is $R^1$—N═, O═, S═, $R^1$—P═, $(R^1)_2P$— or $(R^1)_3P$═, and when Z is $(R^1)_2P$—, n is 1 otherwise n is 0, $R^1$, $R^2$, $R^3$, $R^4$, $R^5$ and $R^6$ are independently hydrogen, amino, hydroxy, mercapto, alkoxy, alkyl, aryl or a heterocyclic moiety, if m is 0, $R^1$ and $R^2$, $R^2$ and $R^3$, and $R^3$ and $R^4$, taken together, can independently represent the carbon and heteroatoms necessary to complete a substituted or unsubstituted carbocyclic or heterocyclic nucleus, or, if m is 1 to 3, $R^1$ and $R^2$, $R^5$ and $R^6$, and $R^3$ and $R^4$, taken together, can independently represent the carbon and heteroatoms necessary to complete a substituted or unsubstituted heterocyclic nucleus, and when $R^5$ and $R^6$ are so defined, p is 0 when ═ is a double bond, and p is 1 when ═ is a single bond.

19. The process of claim 18 wherein m is 0 or 1 and Z is $R^1$—N═.

20. The process of claim 19 wherein said metal complex dye is a magenta dye.

* * * * *